US007859221B2

(12) United States Patent
Baker et al.

(10) Patent No.: US 7,859,221 B2
(45) Date of Patent: Dec. 28, 2010

(54) WIRELESS SCANNER SYSTEM, HEAD AND METHOD

(75) Inventors: Kody J Baker, North Vancouver (CA); Nicholas A Dohmeier, North Vancouver (CA); Trevor Penner, Burnaby (CA); Brian G Anderson, Vancouver (CA)

(73) Assignee: Honeywell International Inc., Morristown, NJ (US)

( * ) Notice: Subject to any disclaimer, the term of this patent is extended or adjusted under 35 U.S.C. 154(b) by 223 days.

(21) Appl. No.: 11/645,473

(22) Filed: Dec. 26, 2006

(65) Prior Publication Data

US 2008/0150478 A1 Jun. 26, 2008

(51) Int. Cl.
*H02J 7/00* (2006.01)

(52) U.S. Cl. ..... 320/108; 320/107

(58) Field of Classification Search ..... 320/107, 320/108

See application file for complete search history.

(56) References Cited

U.S. PATENT DOCUMENTS 3,308,658 A 3/1967 Bryan
3,621,259 A 11/1971 Boissevain
4,131,803 A 12/1978 Takematsu et al.
4,652,937 A * 3/1987 Shimura et al. ..... 379/100.02
5,536,979 A * 7/1996 McEachern et al. ..... 307/104
5,644,663 A * 7/1997 Saito et al. ..... 382/313
5,874,723 A * 2/1999 Hasegawa et al. ..... 235/472.01
5,929,425 A * 7/1999 Kanno ..... 235/472.01
7,051,940 B2 * 5/2006 Tamburrini et al. ..... 235/462.4

FOREIGN PATENT DOCUMENTS

EP 0336959 A 10/1989
EP 1271130 A1 1/2003

* cited by examiner

*Primary Examiner*—Edward Tso
*Assistant Examiner*—Samuel Berhanu
(74) *Attorney, Agent, or Firm*—Ohlandt, Greeley, Ruggiero & Perle

(57) ABSTRACT

A scanning system includes a scanner head that scans along a scan path back and forth across a web. The scanner head is wireless and gets its operating power from an on-board electrical energy storage device, such as a battery or a capacitor. The scanner head docks to a charging station that provides electrical energy to the scanner head for charging the electrical energy storage device. The electrical energy is transferred by an energy coupling relationship that is magnetic field, electric field or direct electrical connection. The magnetic field relationship uses a charging circuit coil and core that mates with scanner head coil and core when the scanner head is docked. The electric field relationship uses a charging side electrically conductive plate that mates with a scanner head electrically conductive plate when the scanner head is docked.

18 Claims, 9 Drawing Sheets

WIRELESS SCANNER SYSTEM, HEAD AND METHOD

FIELD OF THE INVENTION

This invention relates to a wireless scanning system and method for a continuous web material treatment system and to a wireless scanner head used by the system.

BACKGROUND OF THE INVENTION

Web manufacturing systems use a scanner head to measure characteristics of a moving web. For example, the web may be plastic, foil, film, paper, etc. Currently, a powertrack is used to relay power and information between the scanner head and off-head electronics and a power source. The existence of a powertrack means that the scanner support beam must be very large to accommodate all power and communication cables, limiting the potential scanner installation points on a web machine or similar. Power tracks are also a common failure point in scanners with wire fatigue.

There is a need for a scanner head that overcomes the above mentioned disadvantages.

SUMMARY OF THE INVENTION

A scanning system of the present invention comprises a scanner head that scans along a scanning path back and forth across a web. The scanner head comprises at least one electronic unit and an electrical energy storage device that provides operating power to the electronic unit. A charging station is disposed to provide electrical energy to charge the electrical energy storage device.

In one embodiment of the scanning system of the present invention, the electrical energy is transferred from the charging station to the electrical energy storage device by an energy coupling relationship selected from the group consisting of: magnetic field, electric field and electrical connection.

In another embodiment of the scanning system of the present invention, the scanner head docks with the charging station to receive the electrical energy.

In another embodiment of the scanning system of the present invention, the charging station comprises an ac generator that receives input electrical energy and provides output electrical energy at a frequency in the range of about 5 KHz to about 1 MHz.

In another embodiment of the scanning system of the present invention, the scanner head comprises a circuit that receives the electrical energy from the charging station and provides conditioned output electrical energy for charging the electrical energy storage device.

In another embodiment of the scanning system of the present invention, the electrical energy storage device is selected from the group consisting of: capacitor and battery.

In another embodiment of the scanning system of the present invention, the charging station is a first charging station. A second charging station is also disposed to provide electrical energy to charge the electrical storage device. The first and second charging stations are disposed at first and second ends, respectively of the scanning path.

In another embodiment of the scanning system of the present invention, the scanner head docks with the charging station at an end of the scanning path.

In another embodiment of the scanning system of the present invention, the charging station and the scanner head comprise first and second inductive coils, respectively. When the scanner head docks with the charging station, the first and second inductive coils are in a magnetic coupling relationship to transfer the electrical energy from the charging station to the scanner head.

In another embodiment of the scanning system of the present invention, the charging station and the scanner head comprise first and second electrically conductive plates, respectively. When the scanner head docks with the charging station, the first and second electrically conductive plates are in an electric field coupling relationship to transfer the electrical energy from the charging station to the scanner head.

A method of the present invention operates a scanner head by performing the steps of:

moving the scanner head along a scanning path back and forth across the web, wherein the scanner head comprises an electrical energy storage device and at least one electronic unit, charging the electrical storage device with electrical energy, and using the electrical energy storage device to provide operating power to the electronic unit.

In one embodiment of the method of the present invention, the charging step transfers the electrical energy from a charging station to the electrical energy storage device by an energy coupling relationship selected from the group consisting of: magnetic field, electric field and electrical connection.

In another embodiment of the method of the present invention, the scanner head docks with a charging station to receive the electrical energy.

In another embodiment of the method of the present invention, the electrical energy has a frequency in the range of about 5 KHz to about 1 MHz.

In another embodiment of the method of the present invention, the electrical energy storage device is selected from the group consisting of: capacitor and battery.

In another embodiment of the method of the present invention, the charging step uses first and second charging stations disposed at first and second ends, respectively of the scanning path.

A scanner head of the present invention comprises at least one electronic unit, an electrical energy storage device that provides operating power to the electronic unit and an electrical energy receiving circuit that receives electrical energy from an independent charging station for charging the electrical energy storage device.

In one embodiment of the scanner head of the present invention, the scanner head further comprises a docking side that docks along an energy transfer side of the charging station. The electrical energy receiving circuit is disposed adjacent the docking side.

In another embodiment of the scanner head of the present invention, the electrical energy is received via an energy coupling relationship selected from the group consisting of: magnetic field, electric field and electrical connection.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
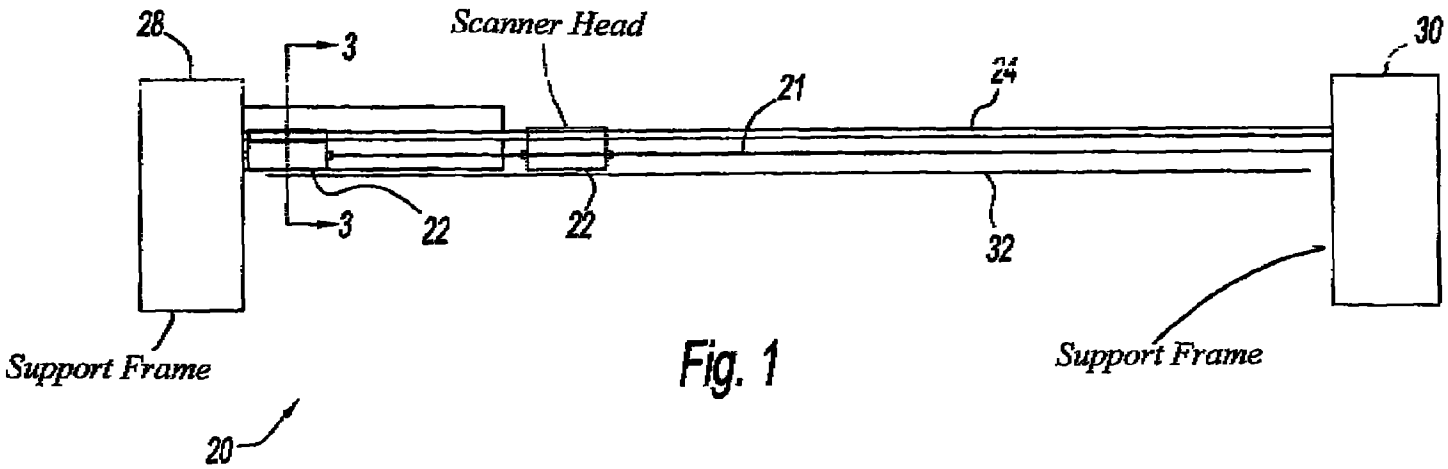
FIG. 1 is a front view of a first embodiment of a scanning system of the present invention.
Figure 2:
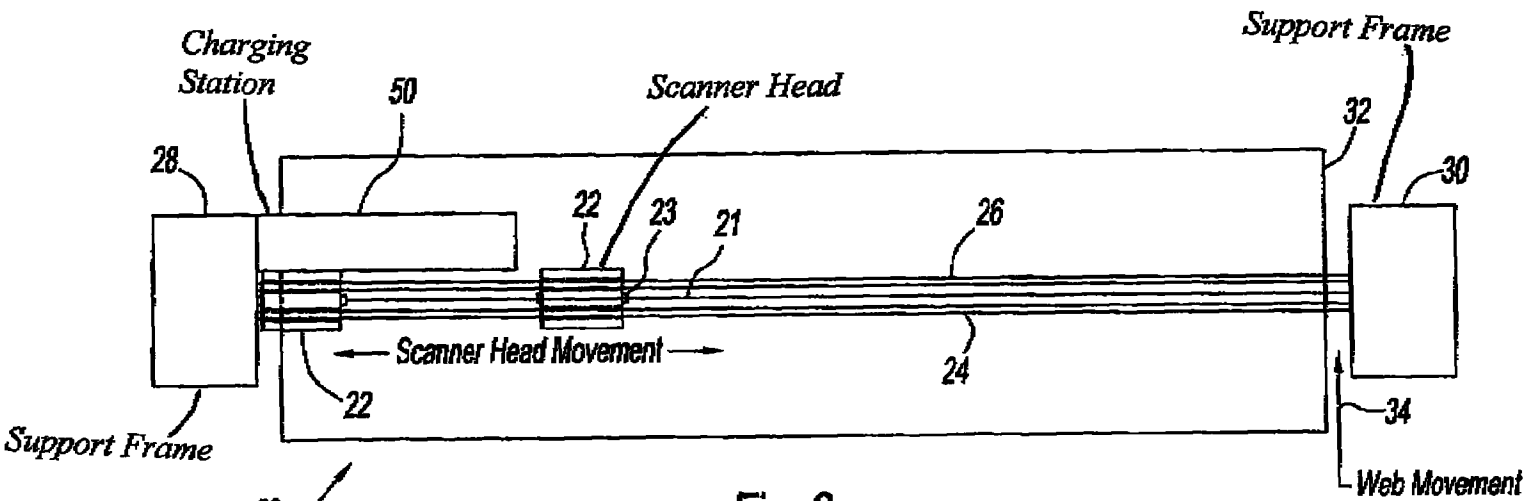
FIG. 2 is a top view of FIG. 1.

Referring to FIGS. 1 and 2, a first embodiment of a scanning system 20 of the present invention comprises a scanner head 22 that travels along scanner beams or guiderails 24 and 26 in a scanning path between a pair of scanner support frames 28 and 30. A web 32 is disposed between support frames 28 and 30 and is moved in a machine direction MD as shown by an arrow 34 in FIG. 2. In some embodiments, web 32 is supplied by a supply spool (not shown) downstream of arrow 34 and taken up by a take up spool (not shown) upstream of arrow 34. In other embodiments, scanner head 22 is mid-process and does not have a supply spool.

Figure 3:
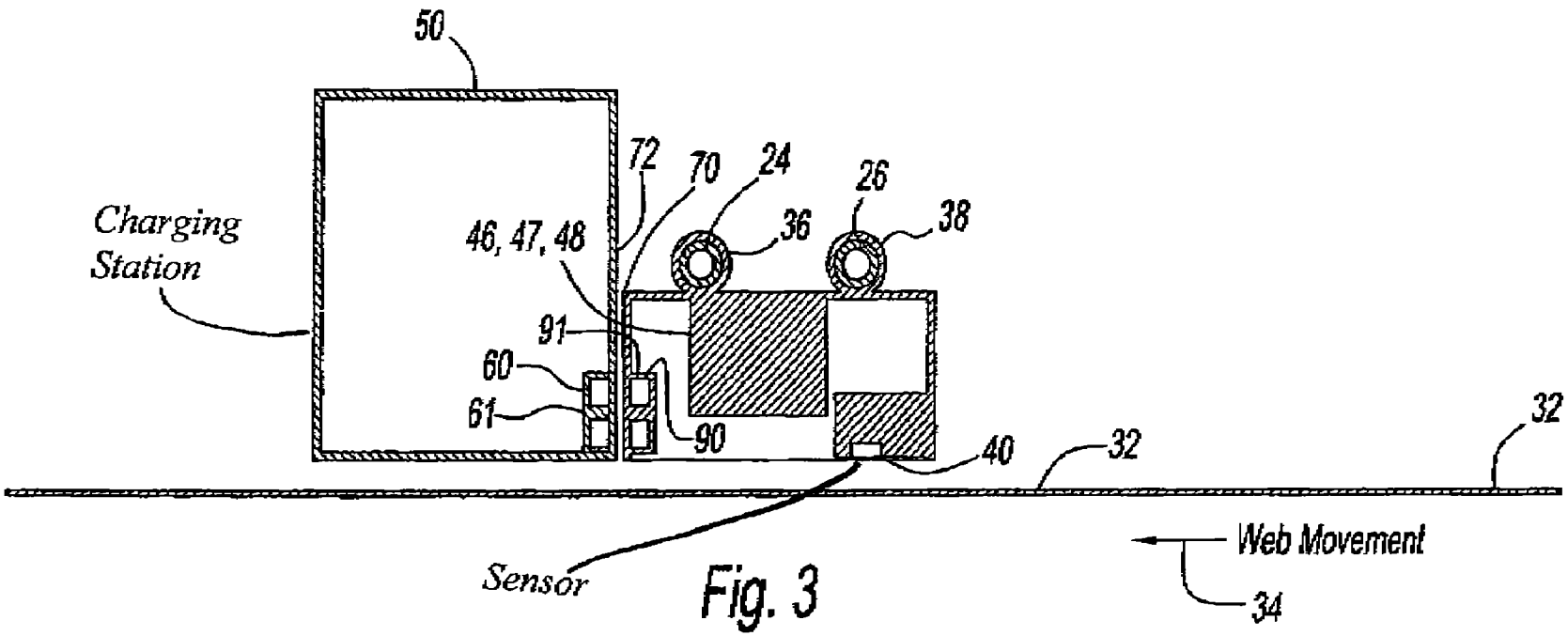
FIG. 3 is a sectional view along line 3 of FIG. 1.
Figure 4:
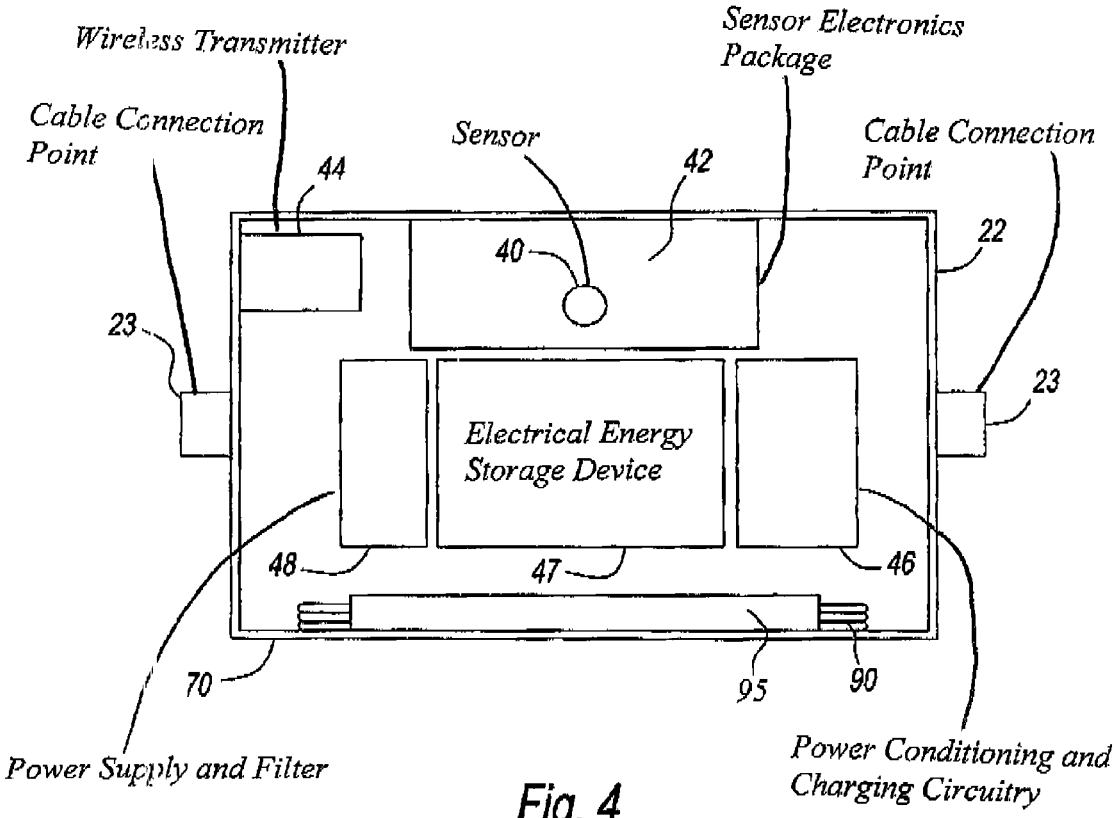
FIG. 4 is a bottom view of the scanner head of the scanning system of FIG. 1.

Referring also to FIGS. 3 and 4, scanner head 22 comprises guide bearings 36 and 38 that mate with guide rails 24 and 26, respectively. For the embodiments shown herein, scanner head 22 is connected to a cable 21 that pulls it side to side via a cable connection point 23 and motorized pulleys (not shown). The motorized pulleys are located in scanner support frames 28 and/or 30.

Scanner head 22 also comprises a sensor 40 that senses conditions of web 32 and a sensor electronics package or unit 42 that provides signals concerning the sensed conditions to a wireless transmitter 44 for wireless transmission to off board electronics (not shown). For example, the sensed conditions may be moisture content, thickness, chemical composition, etc.

Scanner head 22 further comprises a power conditioning and charging circuitry 46 that charges an electrical energy storage device 47 that provides electrical energy or operating voltage to a power supply and filter 48. The power supply and filter provides any required operating voltages to sensors 40, sensor electronic package 42, wireless transmitter 44 and other electrically powered units on board scanner head 22. Electrical storage device 47 may comprise a storage battery, a capacitor or other electrical energy storage device that is chargeable with electrical energy.

As shown in FIGS. 1 and 2, scanner head 22 scans across web 32 from scanner support frame 28 to scanner support frame 30 and back again. Scanner support frame 28 comprises a charging station 50. Scanner head 22 pauses at charging station 50, which provides electrical energy to charge electrical energy storage device 47 with enough electrical energy for a scanning trip across the web 32 and back. Should electrical storage device 47 not have enough storage capacity for a round trip, an additional charging station can be added at support frame 30. Scanner head 22 is shown in solid lines at charging station 50 and with dashed lines in a scanning location. The electrical energy can be transferred to electrical energy storage device 46 by electrical connections, magnetic field circuitry, electrical field circuitry or any combination thereof.

An electronic controller (not shown) for the scanner head 22 is located in scanner support frame 28 or 30. The electronic controller controls the motorized pulleys that pull on cable 21 that is attached to scanner head 22. Programmed logic determines how long the scanner head 22 is to remain in the charging station 50 before an opposite side motorized pulley begins to pull scanner head 22 back across web 32. The amount of time off web can be minimized by increasing the size of the power transfer unit. Wireless communications from sensor head 22 can be used to inform the programmed logic if electrical storage device 47 is running low and necessitates a longer dwell time.

Another arrangement is such that the charging occurs while the scanner head 22 is at the web's edge, thus allowing continuous scanning without any breaks in time for charging off-sheet.

A second charging station (not shown) could be used in embodiments in which the energy storage capacity of the electrical energy storage device is inadequate for a round trip of scanner head. By way of example, charging station 50 is shown herein as employing circuitry that transfers the charging energy via magnetic coupling. Charging station 50 comprises an inductive coil 60 that provides magnetic energy to electrical storage device 47 via power conditioning circuitry 46. Upon arrival at charging station 50, sensor head 22 comes into magnetic coupling relationship with inductive coil 60. A ferrite, iron powder, or magnetic structure made from laminations of steel and or iron forms a shroud 61 around inductive coil 60.

Figure 5:
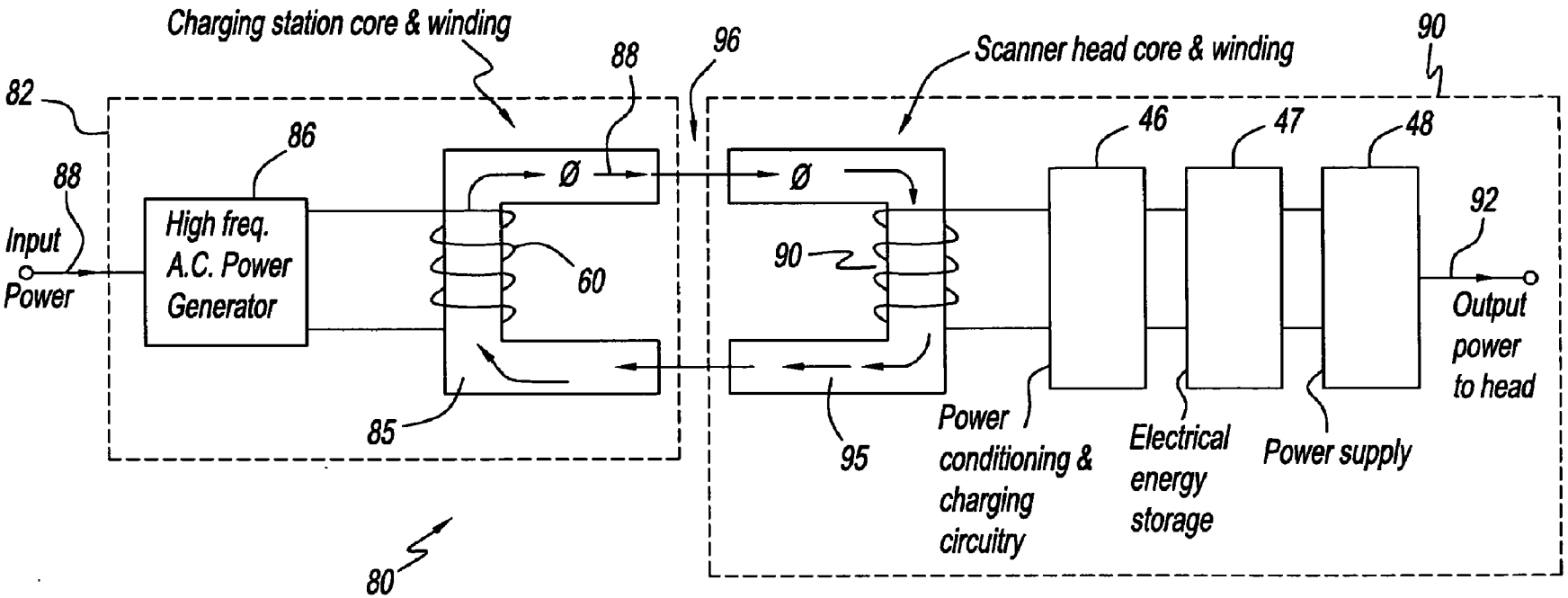
FIG. 5 is an electrical diagram of electrical circuitry that charges an on board energy storage device of the scanner head of the system of FIG. 1 using magnetic energy coupling.

Referring to FIG. 5, an electrical circuit 80 comprises a charging station portion 82 and a scanner head portion 84. Charging station portion 82 comprises an ac high frequency generator 86 connected in circuit with an input 88 and inductive coil 60. Inductive coil 60 is wound on a core 85. Input 88 receives system input power such as single or multiple phase ac or dc power. By way of example, the system input power for the purpose of this description is 208 volts ac, 3-phase, 60 Hz. The input voltage is converted by ac generator 86 to a frequency in the range of about 5 KHz to about 1 MHz. The output of ac generator 86 provides a current flow in inductive coil 60 that produces magnetic flux 88.

Scanner head portion 84 comprises an inductive coil 90 connected in circuit with a power conditioning and charging circuitry 46. The output of power conditioning charging circuitry 46 is connected in circuit with electrical energy storage device 47. Inductive coil 90 is disposed in magnetic field coupling relationship with inductive coil 60 of charging station 50. To this end, inductive coil 90 is wound on a core 95. Physically, cores 85 and 95 are two separate ferrite, iron powder or laminated cores with individual windings. Core 95 is located along a docking side 70 of scanner head 22 that docks against a side 72 of charging station 50 as shown in FIG. 3 opposite core 85 of charging station portion 182. These locations are chosen to provide a high efficiency of magnetic field coupling. When in the energy coupling position they share the same magnetic structure with an air gap 96. Current flow in inductive coil 85 produces a magnetic field 88 that induces a current flow in inductive coil 90 that charges electrical energy storage device 47 via power conditioning circuitry 46. Electrical energy storage device 47 provides operating voltage to power supply 48 which supplies output power 92 to sensor(s) 40, sensor electronic package 42, wireless transmitter 44 and other electrically powered units on board scanner head 22. As scanner head 22 scans across web 32, the charge of electrical energy storage device 36 is discharged by current flow through sensor 40, sensor electronic package 42, wireless transmitter 44 and other electrically powered units on board scanner head 22 to a circuit reference, such as circuit ground.

Figure 6:
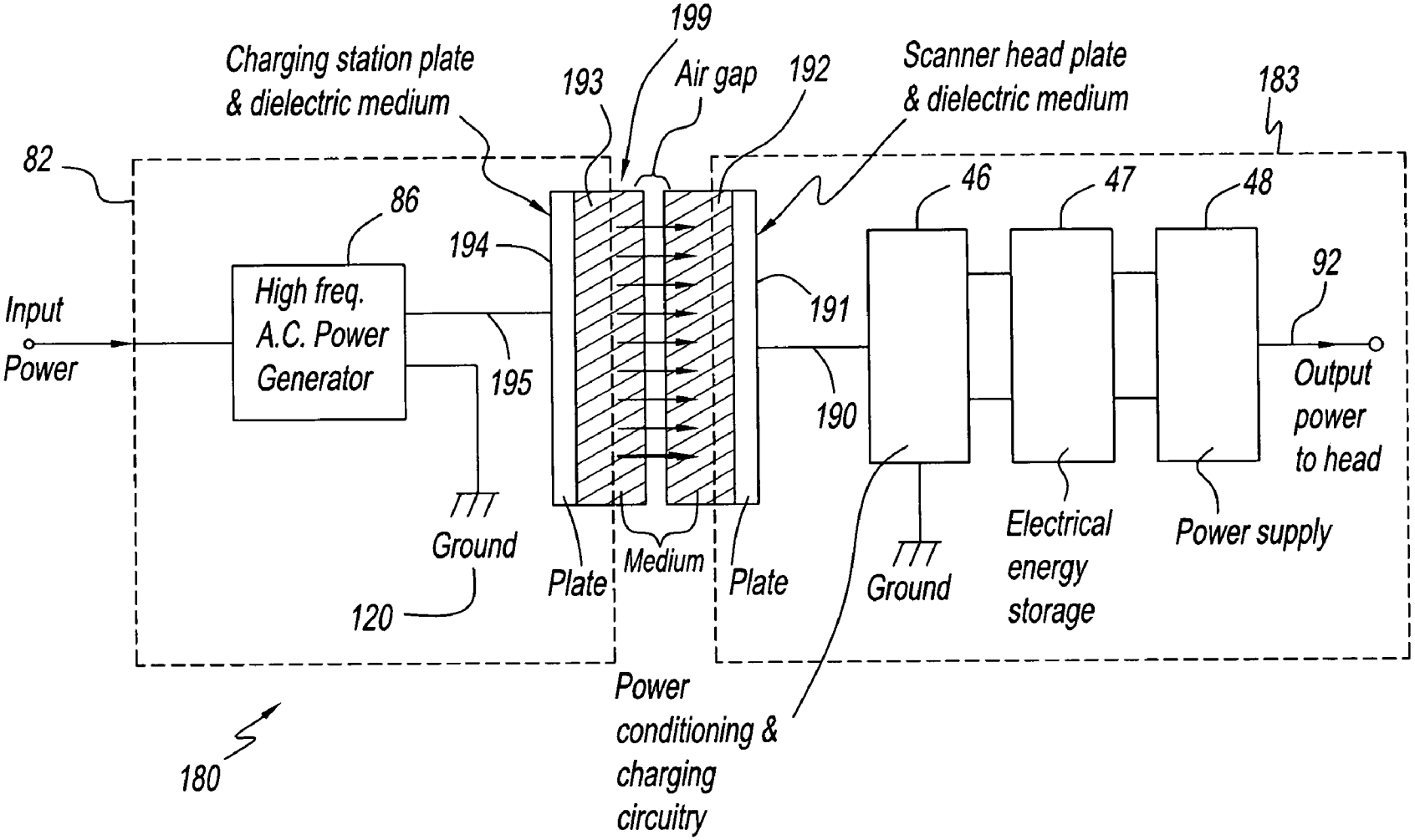
FIG. 6 is an electrical diagram of the circuitry that charges an on board energy storage device of the scanner head of the system of FIG. 7 using electric energy coupling.
Figure 7:
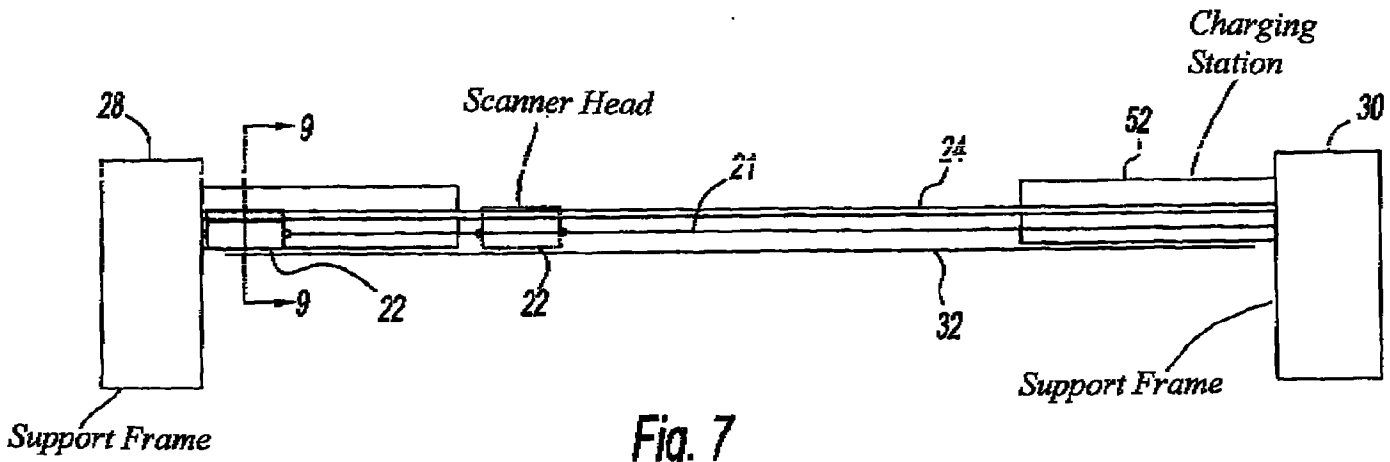
FIG. 7 is a front view of a second embodiment of a scanning system of the present invention.
Figure 8:
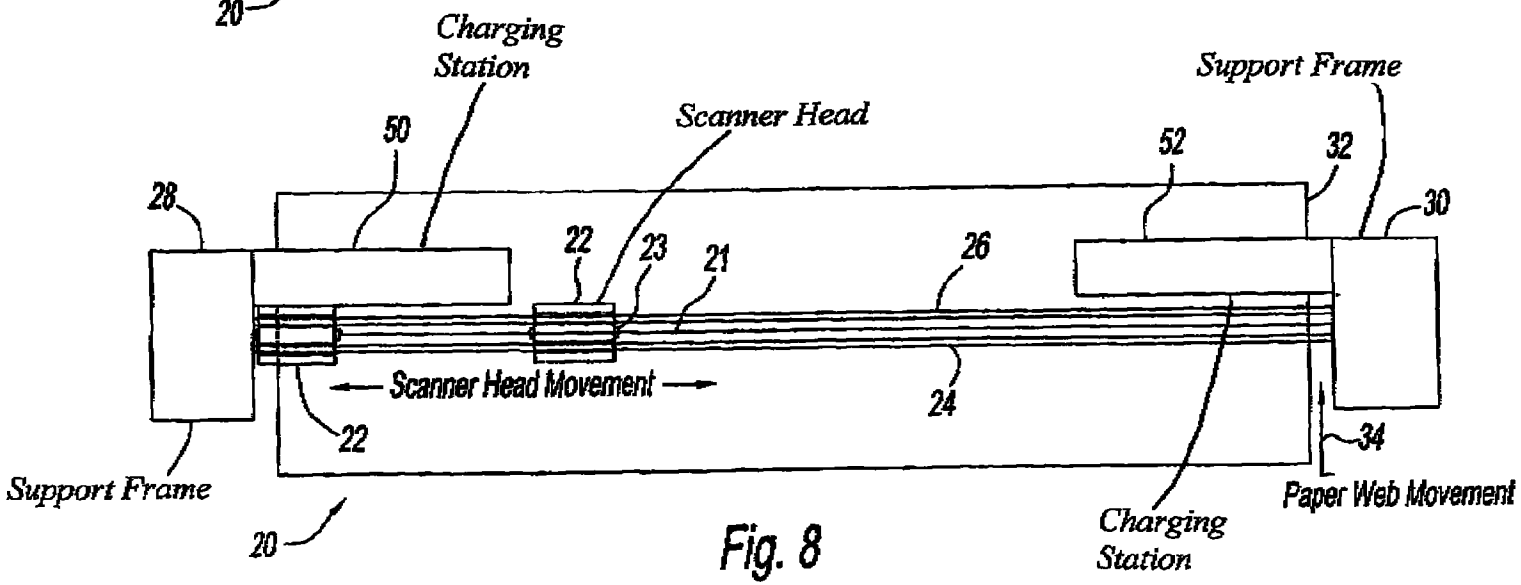
FIG. 8 is a top view of FIG. 7.

Referring to FIGS. 6-10, a second embodiment of scanning system 20 employs many of the same elements of the first embodiment (FIGS. 1-5), which bear the same reference numerals. There are some differences in charging station configuration and in scanner head 22. The second embodiment uses an additional charging station 52 located at scanner support frame 30 as shown in FIGS. 7 and 8.

Figure 9:
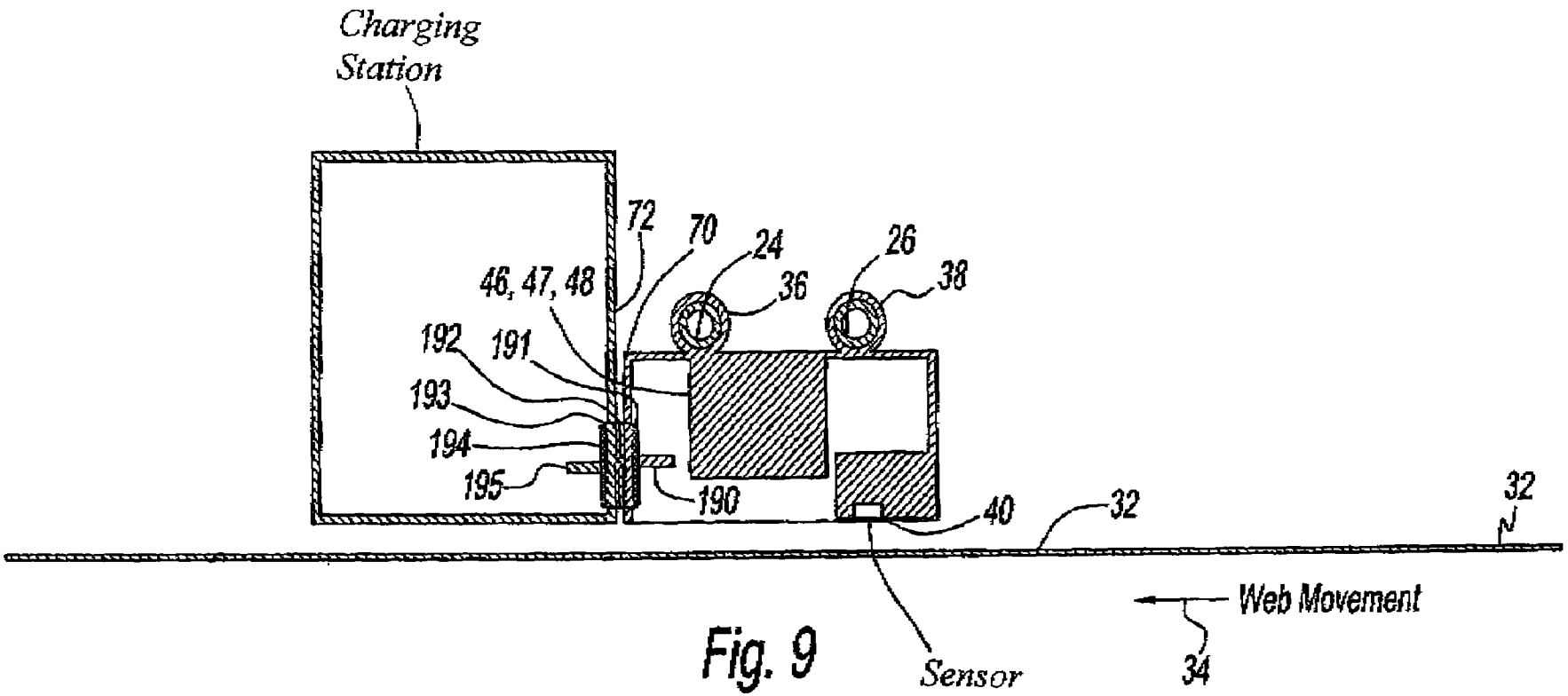
FIG. 9 is a sectional view along line 9 of FIG. 7.
Figure 10:
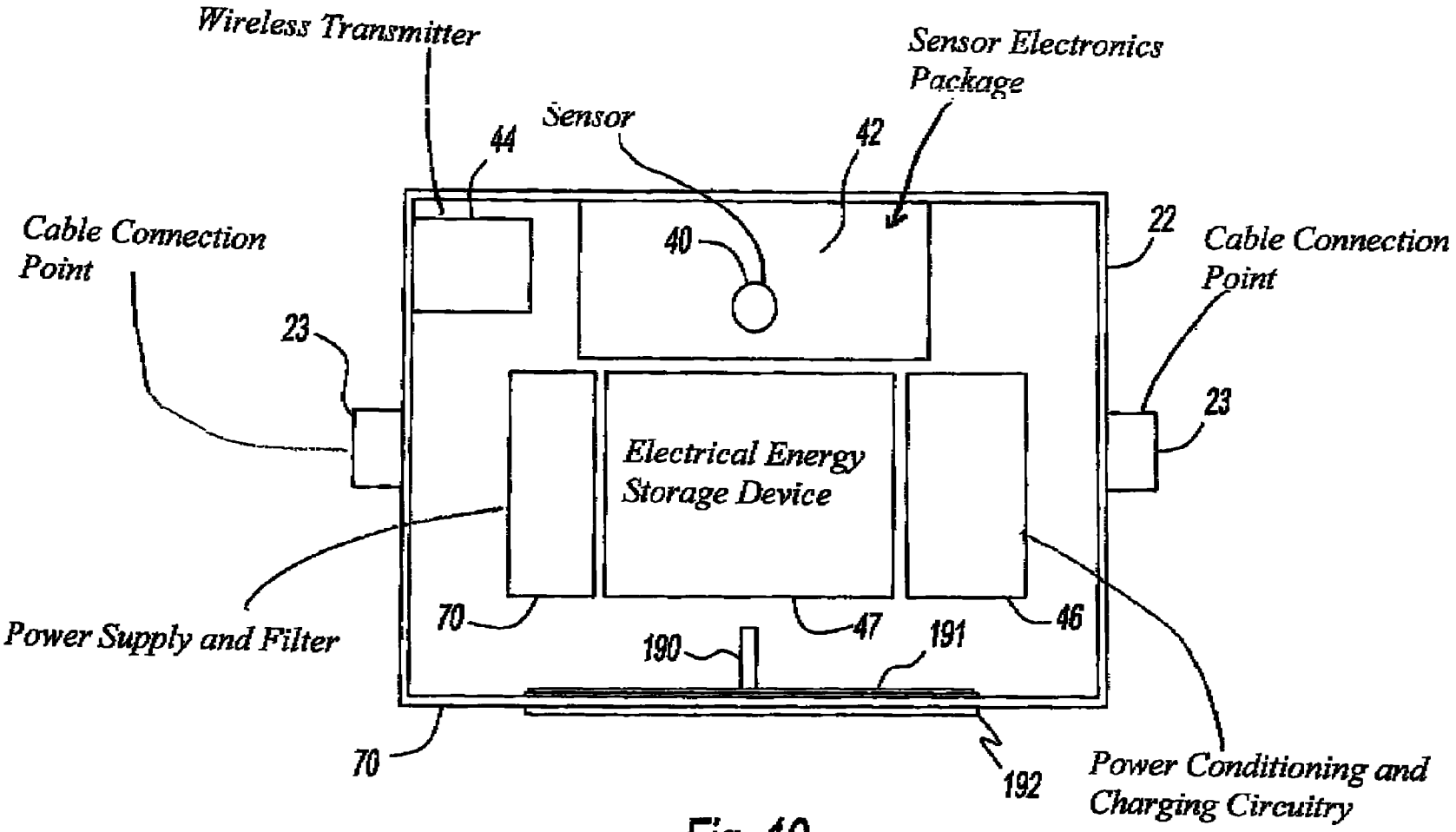
FIG. 10 is a bottom view of the scanner head of the scanning system of FIG. 7.

Referring to also to FIGS. 6, 9 and 10, an electrical circuit 180 comprises a charging station portion 182 and scanner head portion 183. Charging station portion 182 comprises ac high frequency generator 86 connected in circuit with an input 88 and a conductive plate 194 that is attached to a dielectric medium 193. Input 88 receives system input power such as single or multiple phase ac or dc power. By way of example, the system input power for the purpose of this description is 208 volts ac, 3-phase, 60 Hz. The input voltage is converted by ac generator 86 to a frequency in the range of about 5 KHz to about 1 MHz.

Sensor head portion 183 comprises a conductive plate 191 attached to a dielectric medium 192 that are located along docking side 70 of scanner head 22 that docks against side 72 of charging station 50 as shown in FIGS. 9 and 10 opposite plate 194 and dielectric 193 of charging station portion 182. These locations are chosen to provide a high efficiency of electric field coupling. Dielectric mediums 193 and 192 are chosen to have a good dielectric constant and be low friction (such as PTFE (Teflon™) Glass and silicon could also be used. The second embodiment uses a ground path 120 to complete the circuit from ac generator 86. A ground connection would be required on sensor head 22.

When scanner head 22 docks at charging station 50, conductive plates form opposite plates of a capacitor with an air gap 199 in between. High frequency ac power generator 86 provides a current flow through this capacitor and power conditioning circuitry 46 to ground.

Figure 11:
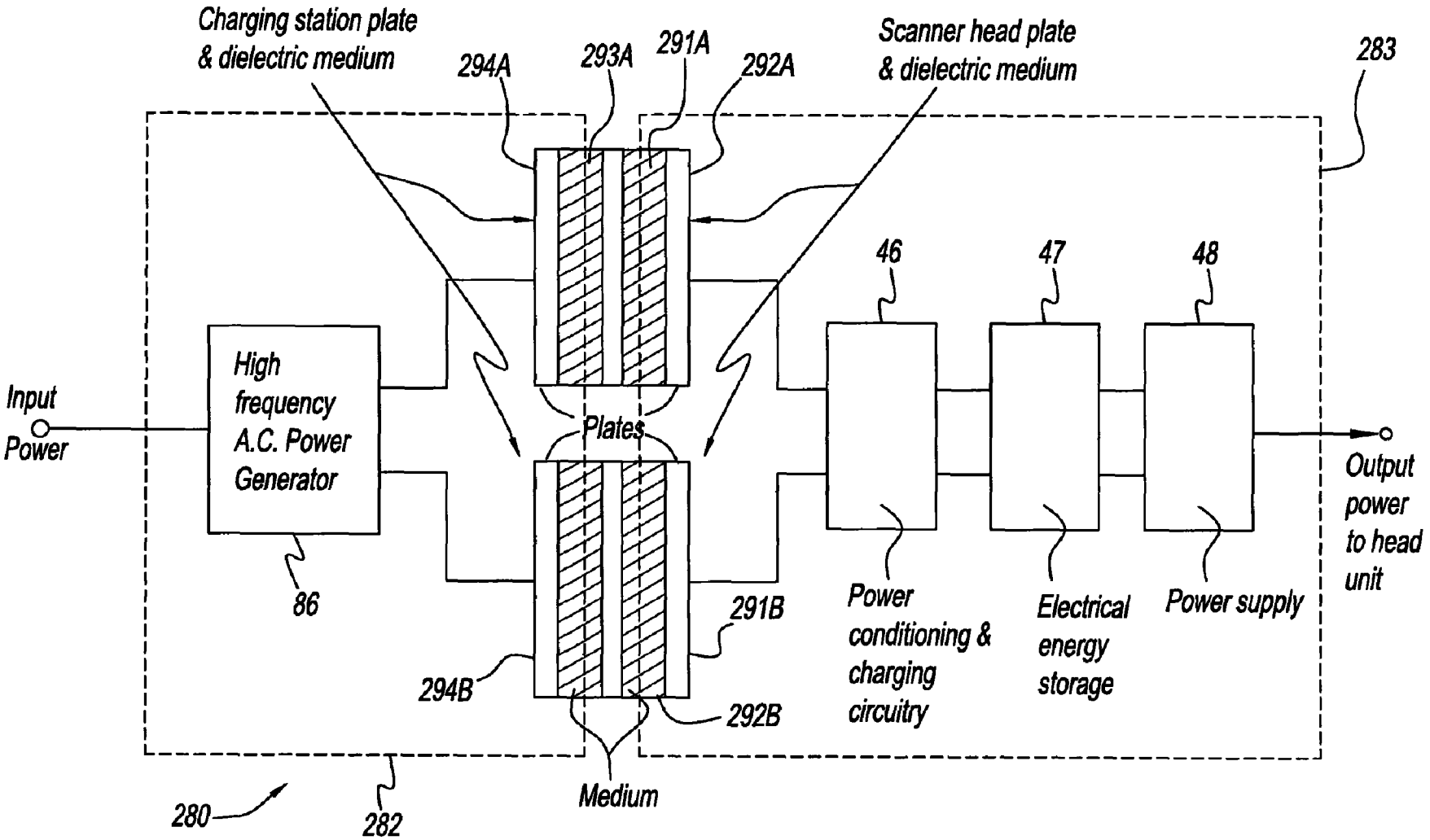
FIG. 11 is an electrical diagram of an alternate embodiment of the circuitry that charges an on board energy storage device of the scanner head of the system of FIG. 7 using electric energy coupling.

An alternate circuit 280 is shown in FIG. 11 that does not require a ground connection. Circuit 280 is similar to circuit 180 with two exceptions. The ground connection is omitted from high frequency ac generator 86 and from power conditioning and charging circuit 46 and two capacitors are used instead of one. To this end, a charging station portion 282 comprises two plates 294A and 294B disposed in stacked relation (one above the other). A scanner head portion 283 comprises two plates 291A and 291B disposed in stacked relation (one above the other) and located to face plates 294A and 294B. Separate dielectric mediums 293A and 293B are attached to plates 294A and 294B, respectively. Separate dielectric mediums 292*a* and 292B are attached to plates 291A and 291B, respectively.

The present invention having been thus described with particular reference to the preferred forms thereof, it will be obvious that various changes and modifications may be made therein without departing from the spirit and scope of the present invention as defined in the appended claims.

What is claimed is:

1. A scanning system for a web comprising:

a scanner head that scans along a scanning path back and forth across said web and that comprises at least one electronic unit and an electrical energy storage device that provides operating power to said electronic unit; and a charging station disposed to provide electrical energy to charge said electrical energy storage device with enough energy to provide said operating power to said electronic unit for at least one trip of said scanner head across said web, wherein said scanner head docks with said charging station to receive said electrical energy to charge said electrical energy storage device at an end of said scanning path.

2. The scanning system of claim 1, wherein said electrical energy is transferred from said charging station to said electrical energy storage device by an energy coupling relationship selected from the group consisting of: magnetic field, electric field and electrical connection.

3. The scanning system of claim 1, wherein said charging station comprises an ac generator that receives input electrical energy and provides output electrical energy at a frequency in the range of about 5 KHz to about 1 MHz.

4. The scanning system of claim 1, wherein said scanner head comprises a circuit that receives said electrical energy from said charging station and provides conditioned output electrical energy for charging said electrical energy storage device.

5. The scanning system of claim 1, wherein said electrical energy storage device is selected from the group consisting of: capacitor and battery, and wherein said scanning head pauses at said charging station for a predetermined time.

6. The scanning system of claim 1, wherein said charging station is a first charging station, wherein a second charging station is also disposed to provide electrical energy to charge said electrical storage device, and wherein said first and second charging stations are disposed at first and second ends, respectively of said scanning path.

7. The scanning system of claim 1, wherein said charging station and said scanner head comprise first and second inductive coils, respectively, and wherein said first and second inductive coils, when said scanner head docks with said charging station, are in a magnetic coupling relationship to transfer said electrical energy from said charging station to said scanner head.

8. The scanning system of claim 1, wherein said charging station and said scanner head comprise first and second electrically conductive plates, respectively, and wherein said first and second electrically conductive plates, when said scanner head docks with said charging station, are in an electric field coupling relationship to transfer said electrical energy from said charging station to said scanner head.

9. The scanning system of claim 1, wherein said electronic unit and said electrical energy storage device travel with said scanner head along said scanning path.

10. A method of operating a scanner head for a web comprising:

moving said scanner head along a scanning path back and forth across said web, wherein said scanner head comprises an electrical energy storage device and at least one electronic unit;

using said electrical energy storage device to provide operating power to said electronic unit; and charging said electrical storage device with enough electrical energy to operate said electronic unit for at least one trip of said scanner head across said web, wherein said scanner head docks with a charging station to receive said electrical energy to charge said electrical energy storage device at an end of said scanning path.

11. The method of claim 10, wherein said charging step transfers said electrical energy from a charging station to said electrical energy storage device by an energy coupling relationship selected from the group consisting of:

magnetic field, electric field and electrical connection.

12. The method of claim 10, wherein said electrical energy has a frequency in the range of about 5 KHz to about 1 MHz.

13. The method of claim 10, wherein said electrical energy storage device is selected from the group consisting of: capacitor and battery, and wherein said scanning head pauses at said charging station for a predetermined time.

14. The method of claim 10, wherein said charging station is a first charging station, and wherein said charging step uses said first station and a second charging stations disposed at first and second ends, respectively of said scanning path.

15. The method of claim 10, wherein said electronic unit and said electrical energy storage device travel with said scanner head along said scanning path.

16. A scanner head for a web comprising:

at least one electronic unit, an electrical energy storage device that provides operating power to said electronic unit and an electrical energy receiving circuit that receives electrical energy from an independent charging station for charging said electrical energy storage device with enough energy to operate said electronic unit for at least one trip of said scanner head across said web; and a docking side of said scanner head that docks along an energy transfer side of said charging station, and wherein said electrical energy receiving circuit is disposed adjacent said docking side to provide electrical energy to charge said electrical energy storage device of said scanner head.

17. The scanner head of claim 16, said electrical energy is received via an energy coupling relationship selected from the group consisting of:

magnetic field, electric field and electrical connection.

18. The scanner head of claim 16, wherein said electronic unit and said electrical energy storage device travel on said trip across said web.

* * * * *